United States Patent [19]

Bleicher et al.

[11] Patent Number: 4,719,976

[45] Date of Patent: Jan. 19, 1988

[54] HAMMER DRILL

[75] Inventors: Manfred Bleicher, Leinfelden-Echterdingen; Ulrich Bohne, Kohlberg; Karl Wanner, Leinfelden-Echterdingen, all of Fed. Rep. of Germany

[73] Assignee: Robert Bosch GmbH, Stuttgart, Fed. Rep. of Germany

[21] Appl. No.: 825,095

[22] Filed: Jan. 31, 1986

[30] Foreign Application Priority Data

Feb. 26, 1985 [DE] Fed. Rep. of Germany ..... 3506695

[51] Int. Cl.[4] ..... B25D 11/10

[52] U.S. Cl. ..... 173/109; 173/116; 173/123; 74/60

[58] Field of Search ..... 173/47, 48, 109, 116, 173/122, 123; 74/57, 60; 192/66, 99 S

[56] References Cited

U.S. PATENT DOCUMENTS 2,042,168 5/1936 Campbell ..... 192/66

4,325,436 4/1982 Richter et al. ..... 173/13

4,529,044 7/1985 Klueber et al. ..... 173/48

4,537,264 8/1985 Schmid et al. ..... 173/48

*Primary Examiner*—Paul A. Bell

*Assistant Examiner*—James L. Wolfe

*Attorney, Agent, or Firm*—Michael J. Striker

[57] ABSTRACT

A hammer drill is provided with a clutch whose movable part is firmly connected to an axially displaceable drum which supports a wobbling disc driving a percussive mechanism for striking a work tool. The axially fixed clutch part is rotated by driving motor and is backed-up by a housing of the drill. Retroacting forces from the percussive mechanism are transferred via the drum onto the movable clutch part so that the engagement of the clutch is reinforced at the moment when the compression generated by percussive mechanism is maximum. When pressure applied on work tool is relieved, a separating spring disengages the clutch and braking surfaces on the drum limit its axial displacement and brake the rotation of the wobbling disc.

21 Claims, 2 Drawing Figures

HAMMER DRILL

BACKGROUND OF THE INVENTION

The present invention relates in general to a hammer drill and in particular to a hammer drill of the type which includes a housing and, within the housing, means for guiding a work tool, a driving motor coupled by a gear train and a motion converting wobble disc to a reciprocating driving member acting via a resilient buffer, preferably an air cushion, on an axially reciprocating striking member whose energy is transferred to a work tool inserted in the guiding means.

From U.S. Pat. Nos. 4,280,359; 4,537,264 a hammer drill of this kind is known in which the drum supporting the wobbling disc is supported for rotation on an intermediate shaft which in turn is supported in the housing of the hammer drill. In the gear train between the intermediate shaft and the drum of the wobbling disc there is provided a frictional coupling which is normally disengaged by means of a spring so that the drum with the wobbling disc is not driven via the intermediate shaft: only after pressing the work tool on a processed workpiece a corresponding reaction force becomes effective in counteracting the biasing force of the coupling spring and the coupling is brought in its engaged condition, thus transferring torque from the intermediate shaft to the drum and the wobbling disc and hence to the percussive mechanism of the hammer drill. The moving part of the coupling in this known embodiment consists of a conical shaft end which is fixedly connected to the rotary intermediate shaft. The other coupling part is formed by the drum provided with the wobbling disc, the drum being firmly stayed in axial direction relative to the housing. The effect of the coupling between the driving motor and the driving member of the percussive mechanism depends on pressure exerted by operator against a workpiece. If the pressing force is sufficiently large, the intermediate shaft which acts as a carrier of the movable coupling part is displaced axially against the force of a separation spring into an inner cone of the axially fixed part of the coupling on the drum supporting the wobbling disc and consequently the drum with the wobbling disc and the percussive mechanism are activated. Due to this prior art design the operation of the hammer drill is rendered difficult. Also a reliable engagement of the driving member of the percussive mechanism depends on individually different, nonreproducible circumstances, such as for example different pressing forces applied on the hammer drill by different users. Moreover, due to the support of the drum carrying the wobbling disc, the reaction forces from the percussive mechanism taken up by the housing act in the direction of disengagement of the coupling. Hence, precisely at the point of greatest compression when the percussive mechanism is supposed to apply the largest compressing force and consequently in the range of the drum with wobbling disc to apply the largest torque to the coupling, the reaction force acting in the direction of the disengagement of the coupling has its peak value. For this reason, the operator has to apply relatively large pressing forces on the hammer drill.

SUMMARY OF THE INVENTION

It is therefore a general object of the present invention to overcome the above mentioned disadvantages.

In particular, it is an object of this invention to provide such an improved hammer drill which in comparison with prior art has the advantage in an extremely small pressing force required from the user during the hammer drilling operation whereby the actual locking force acting on the coupling is markedly larger than in conventional hammer drills.

In keeping with these objects and others which will become apparent hereafter, one feature of this invention resides, in a hammer drill of the before described kind, in a combination in which the movable part of the coupling which performs the engaging and disengaging movements is rigidly connected to the wobbling disc for a joint rotation therewith and the other coupling part is firmly supported in the housing of the hammer drill, and means for pressing the movable coupling part together with the wobbling disc, by the action of the percussive mechanism, against the axially fixed other coupling part which takes up the percussive reaction forces.

Due to the firm connection of the engageable and disengageable coupling part with the rotary wobbling disc while the other coupling part is fixedly supported on the housing to take up the reaction forces from the percussive mechanism, the return strokes of the percussive mechanism acting on the wobbling disc produce an amplification of the pressing force on the two coupling parts. The locking connection of the two coupling parts is thereby increased by the compressing force of the percussive mechanism. Consequently, when a largest force is needed by the percussive mechanism for driving the piston as is the case at the moment of the greatest compression of the gaseous spring or air cushion of the percussive mechanism, the torque transmitted by the coupling is also at its peak due to the kickback of the percussion. Therefore, the operator experiences a substantially simpler manipulation and the pressing forces needed to be applied against a workpiece are substantially smaller. The resulting hammer drill is lightweight, economic to manufacture, compact in design and vibration free.

In a preferred embodiment of this invention, there is provided a separation spring between the two coupling parts, the spring acting in the disengaging direction. The separating spring is dimensioned such that even if the hammer drill is turned upwards any resetting forces resulting from the own weight of respective parts of the percussive mechanism and of the drive, are sufficiently counteracted and the coupling is kept in disengaged condition.

In another preferred embodiment of this invention the drum which is integral with the movable coupling part is provided with firm braking or stop surfaces which in the disengaged condition of the coupling are pressed by the separating spring against opposite stop surfaces mounted on the housing to stop rotation of the drum and of the movable coupling part. This provision also contributes to a problem free non-load behavior of the hammer drill and to a further reduction of possible vibrations.

In still another advantageous embodiment of this invention the means for transferring retroactive forces from the percussive mechanism are in the form of a fork like lever whose forked end is acted upon by the pressure applied by the work tool against the workpiece. This pressure is transferred in the same direction at an intermediate point onto the drum carrying the movable coupling part. The opposite end of the lever is fulcrummed in the housing and the ratio of distances of the intermediate point to the ends of the lever determines the amplification of the transmitted power. In a modification, the lever acts also with an amplified power on the drum in disengaging direction so as to facilitate the disengagement of the coupling parts. In the latter case, the separating spring acts on the fork-like end of the lever at a distance from its contact point with the drum carrying the movable coupling part and the lever is equipped with a catch engaging a collar or flange on the corresponding end of the drum opposite the coupling. In this manner, the force of the separating spring is amplified and the lever easily disengages the two coupling parts and simultaneously the braking effect of the stop surfaces is improved and the rotation of the drum is effectively stopped. The separating spring in this modification is spaced apart from rotating parts and is not subject to any wear.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
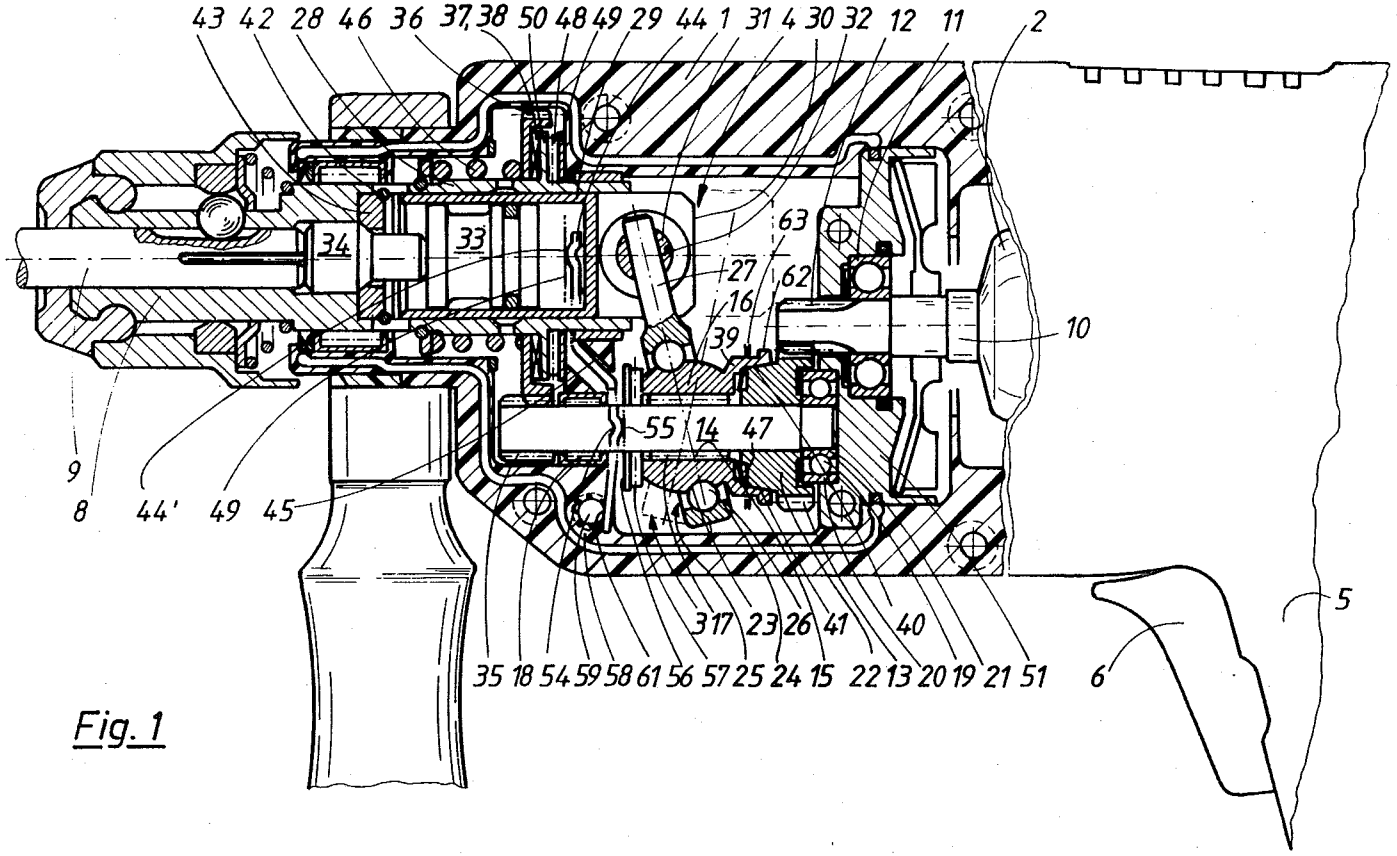
FIG. 1 a side view partly in section of a schematically illustrat hammer drill according to a first embodiment of this invention.

The hammer drill illustrated in FIG. 1 has a housing 1 in which an electric motor 2, a gear train 3 and a percussive mechanism 4 are accommodated. Axis 4' of the percussive mechanism 4 extends parallel to the axis of rotation of the electric motor 2. Rear part of housing 1 transits in a handle 5 in which a power switch controlled by a pushbutton 6 is installed, through which the electric motor 2 is activated. The lower end of the handle 5 is provided with an elastic sleeve (nonillustrated) through which a power supply cable is led in. The front end of the housing remote from the hand grip 5 is provided with a work tool holder 8 serving for receiving work tools, for example a drill bit 9.

The electric motor 2 has a driving shaft 10 which at both ends thereof is rotatably supported in housing 1 by ball bearings of which ball bearing 11 is shown in the drawing. The end of driving shaft 10 projecting through ball bearing 11 is provided With a pinion 12 which meshes with a gear 13. Preferably, the gear 13 and the motor pinion 12 are helical gears. The gear 13 is fixedly connected for example by pressing to a rotary intermediate shaft 14. The end of intermediate shaft 14 adjoining the gear 13 is supported for rotation in a ball bearing 19 whose outer race 20 is firmly connected to a partition 51 of housing 1 whereas the inner race 21 of bearing 19 is attached to a stepped down end portion of the intermediate shaft. The intermediate shaft passes through an axial bore 15 of a drum 16. The diameter of the bore 15 is larger than the diameter of the intermediate shaft and the drum 16 is rotatably supported on the intermediate shaft by means of a needle cage 17. The needle cage 17 is dimensioned such that the drum 16 is slightly shiftable in axial direction relative to the intermediate shaft 14. An end portion of the intermediate shaft 14 remote from the ball bearing 19 is supported for rotation in a needle bearing 18 whose outer race is secured to a partition of housing 1. The free end of the intermediate shaft projecting from the needle bearing 18 is fixedly connected to a pinion 35 whose function will be explained below.

The jacket of drum 16 is formed with a bearing groove 23 whose plane is inclined relative to the axis of rotation of the intermediate shaft 14. The bearing groove 23 represents an inner raceway for balls 24 of ball bearing 25. Outer race of ball bearing 25 forms a wobbling disc 26 provided with a finger 27 which is in driving contact with the percussive mechanism 4.

The percussive mechanism 4 is arranged within a guiding tube 28 which is rotatably supported in housing 1. In this embodiment the guiding tube 28 is firmly connected to the inner end of a tubular work tool holder 8. Within the guiding tube 28 there is arranged an axially reciprocating piston 29 which is in tight sliding contac with the inner wall of the guiding tube and acts as a driving member of the percussive mechanism. The end portion of piston 29 remote from tool holder 8 has a fork-shaped configuration and supports a pivot pin 31. An intermediate part of the pivot pin is formed with a transverse bore 82 which is in loose engagement with the finger 27 of the wobbling disc. In this manner, the finger 27 easily moves in its axial direction through the transverse bore 32. Within the hollow piston 29 a cylindrical striking member 33 is guided in sealing contact with the inner wall of the piston to act via an anvil 34 against the rear end of the work tool 9.

The above mentioned pinion 35 secured to the free end of the intermediate shaft 14 side by side with the needle bearing 18 is in mesh with a gear 36 which is shiftably supported on the jacket of guiding tube 28 and is free to rotate about the center axis of the latter. The gear 36 is biased by a pressure spring 46 against a flange 50 formed near the rear end of the guiding tube 28. The facing end surfaces of the gear 36 and of the flange 50 are formed with radial projections 37 and 38, respectively. The projections engage each other and due to the biasing effect of pressure spring 46 serve as an overload coupling. The driving gear 13 pressed on the opposite end of the intermediate shaft is provided with a frusto-conical hub 22 whose conical outer surface 41 converges in axial direction toward the drum 16. The juxtaposed end of drum 16 is provided with a frusto-conical sleeve 39 whose inner conical wall 40 matches the outer conical surface of the conical hub 22. The surface 40 and 41 form together a coupling or clutch which in engaged condition connects for joint rotation the drum 16 with the driving gear 13, thus causing a joint rotation of the intermediate shaft 14 with the drum 16. The engagement of the conical coupling 40/41 takes place by the action of the guiding tube 28 which upon pressing the drill bit 9 against a processed workpiece is shifted in axial direction rearward relative to housing 1.

During the axial displacement of the guiding tube, the rear end face of drill bit 9 presses via the anvil 34, an abutment ring 43 and a clip ring 42 the guiding tube 28 rearwards. Accordingly, pressure applied against the drill bit 9 causes an axial shift of the tool holder 8 together with guiding tube 28 into the housing 1. During this relative shift, the flange 50 on the jacket of guiding tube 28 presses via an axial bearing 48 and an annular disc 49 against the fork-like end 44 of the power transferring lever 45. Of the two prongs of the fork-like end 44 of the lever embracing the guiding tube 28, only one prong or shank is illustrated in FIG. 1. The other end 54 of lever 45 has also a fork-like shape and embraces the intermediate shaft 14. At the level of the center axis of the intermediate shaft 14 the lever 45 is provided at both shanks of the fork-like end 54 with projections 55 slidably engaging a disc 56 which in turn is connected via an axial bearing 57 to the corresponding end face of the drum 16. The free ends of the fork-like part 54 of lever 45 are held in a recess 58 in housing 1. An eccentric pin 59 is rotatably supported in proximity to the recess 58 and is adjusted to engage a surface 61 at the opposite side of fork-like portion 54 of lever 45 below the contact point between the projection 55 and the disc 56. The eccentric pin 59 is adjusted into a position in which the projections 55 are brought into contact with the disc 56 while the oppositely directed projections 44' at the opposite end of lever 45 are in contact with the disc 49 surrounding the rear end of guiding tube 28.

When in pressing a work tool 9 in the hammer drill against a processed workpiece, the guiding tube 28 is shifted into housing 1 and the pressure is transmitted via flange 50, axial bearing 48 onto the annular disc 49 which in turn rotates the upper end 44 of lever 45 about the contact point with the eccentric pin 59. During this pivotal movement, projections 55 axially displace via the annular disc 56 and axial bearing 57 the drum 16 on the needle cage and consequently the sleeve 39 with the inner conical surface 40 engages the outer conical surface 41 on the driving gear 13 and the conical clutch 40/41 is brought into its engaged condition. The lever 45 is made of a resilient material which is dimensioned such that upon a further increase of pressure against the work tool a further rearward displacement of the guiding tube 28 into the housing takes place nevertheless force applied via the projection 55 and drum 16 on the conical coupling or clutch 40/41 does not exceed a predetermined value.

The effect of pressing force an operator applies on the hammer drill is amplified during its transmission by lever 45 on the conical coupling 40/41. The power amplification depends on the ratio of the distance of projections 55 from the points of contact of the lever end 44 with the disc 49 to the distance of the projection 55 from the pivot point at the opposite lever end 54. By adjusting the position of the eccentric pin 59 it is made possible to compensate in simple manner manufacturing tolerances.

It will be seen from FIG. 1, the movable part of the coupling is the inner conical wall 40 of sleeve 39 which is an integral component part of drum 16 carrying the wobbling disc 26. Consequently, the movable coupling part is pressed by the action of the percussive mechanism 4 against the axially fixed coupling part constituted by the outer conical surface 41 on hub 22 formed on a face of driving gear 13 which in turn is rigidly connected to the rotary intermediate shaft 14 which by means of ball bearing 19 is supported on housing 1. Since the drum 16 is within narrow limits axially shiftable on the intermediate shaft then during drilling operation of the hammer drill, reaction forces resulting from strikes against piston 29 and transmitted to wobbling disc 26 are taken up by the drum and the latter is shifted axially toward the hub 22 whereby the frictional engagement between the two coupling parts 40/41 is still increased. In this manner, the transmission of the driving torque through the conical coupling 40/41 is improved. Accordingly, at the time point when a maximum force is to be transmitted to percussive mechanism 4 for driving the piston 29 and with the maximum compression between the piston 29 and the striking member 33 then the frictional engagement of the coupling parts and the transmitted torque are also maximal. The compressing force generated by the percussive mechanism 4 reacts through piston 29, pivot pin 31, finger 27, wobbling disc 26, bolts 24, drum 16, sleeve 39 and the inner conical wall 40 on the outer conical surface 41 of the hub 22 and is taken up via driving gear 13 and ball bearing 19 by housing 1. This back-up of the reaction force by the housing occurs exactly at the moment when the largest frictional engagement of the coupling and consequently the largest driving moment is required for a slipless rotary driving of drum 16 together with wobbling disc 26. The movable coupling part 39, 40 which is an integral component part of drum 16 is thus always compressed in counter direction to generated strikes and is shifted on intermediate shaft 14 to the right in FIG. 1 to reinforce the engagement with the axially fixed coupling part 22, 41.

It will be understood that in a nonillustrated modification of this embodiment, the coupling parts can be kinematically reversed so that the outer conical surface is provided on the drum whereas the inner conical wall is formed on the corresponding side of driving gear 13.

A separating spring 47 is arranged between the two coupling parts namely between the sleeve 39 and the hub 22. In the embodiment of FIG. 1, the separation spring is in the form of a plate spring whose inner annular part is supported on hub 22 and whose outer annular part is supported on a flange within the sleeve 39. In this case, the separation spring 47 immediately acts on drum 16 supporting the movable coupling part. The separating spring can be also in the form of a pressure spring which exerts an axial pressure between the two coupling parts 40/41 to urge the coupling into its disengaged condition.

The illustration in FIG. 1 shows the coupling 40/41 in its engaged position when the separating force of spring 47 is exceeded.

Sleeve 39 on drum 16 is further provided on its outer surface with a rigid braking member in the form of a collar 62 cooperating with a stationary braking ring 63 secured to housing The clearance between the opposite braking surfaces is dimensioned such that in disengaged of coupling 40/41 the rotation of drum 16 is immediately stopped and thus any vibrations are prevented.

Hammer drill illustrated in FIG. 1 is in an operational condition in which work tool 9 is pressed on a nonillustrated workpiece whereby power transmitting lever 45 is pivoted at contact point with eccentric pin 59 into a position in which projection 55 displaces drum 16 to the right and consequently the movable coupling part with inner conical wall 40 is pressed against the rotating but axial fixed outer conical surface 41 on hub 22 and coupling is in its engaged condition. The force of separating spring 47 is thereby overcome.

When back pressure from work tool 9 decreases, the separating spring 47 shifts drum 16 with the movable coupling part 39, 40 away from the axially fixed coupling part 22, 41 and the coupling 40/41 is disengaged. This axial movement is stopped after flange 62 on the sleeve 39 abuts against the stationary stop ring 63 of the housing. The engaging surfaces of flange 62 and ring 63, as mentioned before act as braking surfaces which stop the rotation of drum 16 and consequently the percussive mechanism 4. However, the driving mechanism consisting of motor pinion 12, driving gear 13, hub 22, intermediate shaft 14, shaft pinion 35, gear 36, overload coupling 37/38, flange 50 and guiding tube 28 with tool holder 8, keep running.

By virtue of the amplification of the compression force exerted by percussive mechanism 4 against the coupling and hence the increase of transmitted torque from driving mechanism, the operation comfort of the hammer drill is substantially increased because the operator need not press hard against the workpiece.

When coupling 40/41 is in its disengaged condition, the separating spring 47 in the form of a plate spring is practically exposed to no wear because it contacts the interior of sleeve 39 and the hub 22 along a circular line only.

In operation when percussive mechanism 4 brings via the power transmitted lever 45 the coupling 40/41 in its engaged condition then by virtue of the amplification of the force exerted on drum 16 and determined by the ratio of lever arms between the ends 44, 54 and contact projections 55, the generated force is in all cases sufficient for preventing axial displacement of the rotary drum 16 with wobbling disc 26 to the left on the intermediate shaft. In other words, drum 16 is forced by the lower end 54 of lever 45 to the right on the intermediate shaft so as to guarantee reliable engagement of the coupling.

Figure 2:
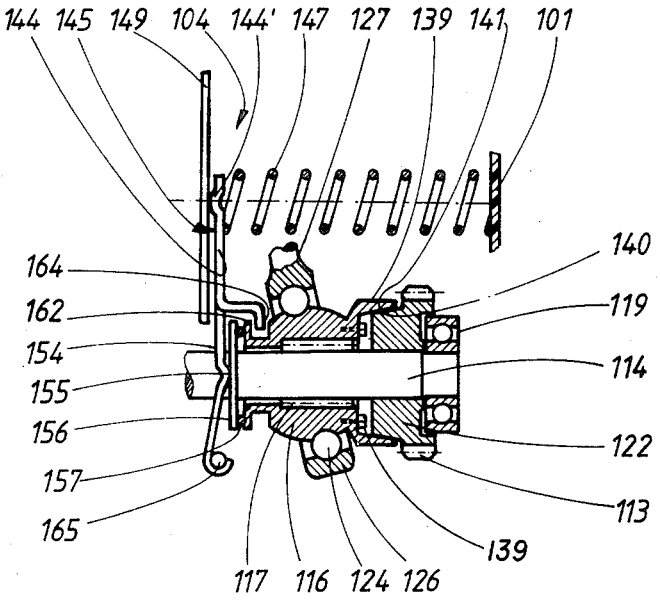
FIG. 2 is a sectional side view of a driving part of the hammer drill of FIG. 1 having a modified power transferring member between the percussive mechanism and a movable part of a coupling.

In the embodiment of this invention illustrated in FIG. 2, the last two digits in reference numerals correspond to reference numerals in the preceding example designating like component parts. The nonillustrated parts of the hammer drill are of the same design as in FIG. 1.

The arrangement of the control mechanism for the coupling shown in FIG. 2 differs from the preceding example by a different location of separating spring 147 which is no longer coaxial with the drum 116 and hub 122 but is situated outside the coupling 140/141. The separating spring 147 in this embodiment is a cylindrical helical spring acting on the upper fork-like end 144 of the power transmitting lever 145. The opposite end of separating spring 147 is supported on a housing partition 101. The axis of separating spring 147 coincides with the center axis of percussive mechanism 104. Preferably, each shank 144 of fork-like lever 145 is loaded by an assigned separating spring.

The lever 145, similarly as in the preceding example, is provided with projections 155 acting via annular disc 156 and axial bearing 157 against an end side of drum 116. An intermediate part of lever 145 is provided with a hook-shaped catch 164 which can be stamped in the material of the lever and shaped by bending. The hook-shaped end portion of the catch 164 is directed at right angles opposite the inner side of a flange 162 formed on the end of drum 16 remote from ball bearing 119. The lower end of lever 146 is pivotably supported on a pin 165 secured to housing 101.

When the work tool is pressed on workpiece, then the corresponding back pressure is transmitted via disc 149 on the fork-like end 144 of lever 145. Consequently the lever is pivoted about the pivot pin 165 against the biasing force of separating spring 147. Projections 155 on the fork-like lower end 154 of the lever exert pressure via disc 156 and axial bearing 157 on the flange 162 of drum 116 and the latter is shifted axially on intermediate shaft 114 to the right until the inner conical wall 140 engages the outer conical surface 141 on hub 122. At this moment, the coupling starts transmitting driving torque and the drum 116 starts rotating and its wobbling disc 127 sets percussive mechanism 104 in reciprocating motion. Similarly as in the preceding example, reaction forces generated in percussive mechanism 104 are taken up via drum 116, clutch 140/141, hub 122 and ball bearing 119 on housing 101. As a result, a largest frictional engagement is automatically developed in coupling 140/141 when a maximum compression between the piston and striking member of percussive mechanism 104 is present, and a maximum driving force is applied to the piston.

When the back pressure from work tool drops, separating spring 147 is relieved and lever 145 is pivoted about pivot pin 165 into its starting position in which the upper fork-like end 144 is displaced to the left. During this return movement of lever 145 the catch 164 engages the flange 162 and moves the drum 116 on the intermediate shaft 114 to the left, thus disengaging the coupling 140/141. When the coupling is disengaged, the outer surface of flange 162 is clamped with the projection 155 of lever 145 whereupon the axial movement of drum 116 is stopped and simultaneously its rotation is braked and the percussive mechanism 104 stands still.

As mentioned before, in the second embodiment the separating spring 147 is not rotated by the coupling and therefore no problems with the wear of the spring occur.

In the embodiment of FIG. 2, movable coupling part 139, 140 is not an integral part of the drum 16 but forms a separate element which is releasably connected to the drum 116, for example by a screw connection 139. In a nonillustrated modification of the embodiment of FIG. 1, the movable coupling part 39, 40 is a separate element which is positively connected by coupling members to drum 16. The coupling members can be for example in the form of coupling face teeth on the movable coupling part 39, 40 and on the end face of drum 16 which engage in axial direction with each other. The coupling members can be also in the form of radial teeth. It will be understood also that needle cage 17 which in the first embodiment serves as a bearing of drum 16 on the intermediate shaft can be dispensed with whereby drum 116 is directly supported on the intermediate shaft 14 for rotation and limited axial displacement on the latter.

In a further nonillustrated embodiment, instead of a frictional conical coupling there is provided a serrated coupling having contact surfaces with interlocking teeth provided on facing ends of drum 16 and of hub 22.

Instead of the air cushion between the piston 29 and the striking member 33 acting as a resilient percussion transmitting medium, it is also possible to employ a suitable spring.

While the invention has been illustrated and described as embodied in specific examples of hammer drills, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A hammer drill having a housing and, within the housing, means for guiding work tool, a driving motor coupled by a gear train and a motion converting wobble disc means to a percussive mechanism acting via a resilient buffer on an axially reciprocating striking member whose energy is transferred to a work tool inserted in said guiding means, comprising a clutch arranged in said gear train to transmit torque from said driving motor to said wobble disc means when brought in engaged condition in response to a contact pressure of the work tool against a workpiece, the clutch including an axially movable clutch part arranged for joint rotation with the wobble disc means and an axially fixed clutch part driven by said gear train and being backed up by said housing, said means for guiding a work tool being supported for axial movement relative to said housing; and said axially movable clutch part being brought into engagement with said axially fixed clutch part by the action of said percussive mechanism transmitting back forces via said wobble disc means when the work tool is pressed against a workpiece.

2. A hammer drill as defined in claim 1, wherein the axially fixed clutch part is rotatably supported in a fixed position in said housing.

3. A hammer drill as defined in claim 2, wherein said gear train includes an intermediate shaft supported for rotation in said housing, a driving gear secured at one end to said shaft and engaging a pinion of said driving motor and said axially fixed clutch part being rigidly connected to said intermediate shaft.

4. A hammer drill as defined in claim 3, wherein said axially fixed clutch part is integrally connected to a side of said driving gear.

5. A hammer drill as defined in claim 4, wherein said wobble disc means includes a wobble disc supported for rotation on a drum which is axially displaceable on said intermediate shaft and said axially movable clutch part being detachably connected to said drum.

6. A hammer drill as defined in claim 4, wherein said wobble disc means includes a wobble disc supported for rotation on a drum which is supported for rotation and axial displacement on said intermediate shaft and said axially movable clutch part being integrally connected to said drum.

7. A hammer drill as defined in claim 6, wherein said drum is supported for rotation and for limited axial displacement on a needle bearing provided on said intermediate shaft.

8. A hammer drill as defined in claim 6, wherein the axial displacement of said movable clutch part and of said drum is limited such that said clutch is brought in its engaged condition by the retroacting force of said percussive mechanism.

9. A hammer drill as defined in claim 8, wherein the clutch is in the form of a frictional conical clutch.

10. A hammer drill as defined in claim 9, wherein said axially movable clutch part has a conical inner wall cooperating with a conical outer surface of said axially fixed clutch part.

11. A hammer drill as defined in claim 10, wherein a side of the driving gear attached to said intermediate shaft is formed with a frusto-conical hub converging toward said axially movable clutch part and being provided on its jacket with said outer conical surface of said axially fixed clutch part.

12. A hammer drill as defined in claim 11; further comprising a separating spring for disengaging said movable clutch part from said fixed clutch part.

13. A hammer drill as defined in claim 12, wherein said separating spring is a conical spring.

14. A hammer drill as defined in claim 12, wherein said separation spring is a plate spring coaxially arranged between said movable and fixed clutch parts.

15. A hammer drill as defined in claim 14, wherein said axially movable clutch part is provided with a stop surface cooperating with an opposite surface provided on the housing to limit the axial displacement of the movable clutch part in disengaging direction and to stop rotation of said drum.

16. A hammer drill having a housing and, within the housing, means for guiding a work tool, a driving motor coupled by a gear train and a motion converting wobble disc means to a percussive mechanism acting via a resilient buffer on an axially reciprocating striking member whose energy is transferred to a work tool inserted in said guidnig means, comprising a clutch arranged in said gear train to transmit torque from said driving motor to said wobble disc means when brought in engaged condition in response to a contact pressure on the work tool against a workpiece, the clutch including an axially movable clutch part arranged for joint rotation with the wobble disc means and an axially fixed clutch part driven by said gear train and being backed up by said housing, said means for guiding a work tool being supported for axial movement relative to said housing and said axially movable clutch part being brought into engagement with said axially fixed clutch part by the action of said percussive mechanism transmitting back forces via said wobble disc means when the work tool is pressed against a workpiece; said axially fixed clutch part being rotatably supported in a fixed position in said housing; said gear train including an intermediate shaft supported for rotation in said housing, a driving gear secured at one end to said shaft and engaging a pinion of said driving motor, said axially fixed clutch part being rigidly connected to said intermediate shaft; said axially fixed clutch part being integrally connected to a side of said driving gear; said wobble disc means including a wobble disc supported for rotaton on a drum which is supported for rotation and axial displacement on said intermediate shaft; said axially movable clutch part being integrally connected to said drum; the axial displacement of said movable clutch part and of said drum being such that said clutch is brought in its engaged condition by the retroacting force of said percussive mechanism; said clutch being in the form of a frictional conical clutch; said axially movable clutch part having a conical inner wall cooperating with a conical outer surface of said axially fixed clutch part; a side of the driving gear attached to said intermediate shaft being formed with a frusto-conical hub converging toward said axially movable clutch part and being provided on its jacket with said outer conical surface of said axially fixed clutch part; a separating spring for disengaging said movable clutch part from said fixed clutch part; said separting spring being a plate spring coaxially arranged between said movable and fixed clutch parts; said axially movable clutch part being provided with a stop surface cooperating with an opposite surface provided on the housing to limit the axial displacement of the movable clutch part in disengaging direction and to stop rotation of said drum; and further comprisng a power transmitting member in the form of a fork-like lever anchored in said housing and extending between said axially displaceable guiding means and said drum, said lever acting on said drum in the engaging direction of said movable clutch part against the force of the separating spring and the ratio of distancs of the contact point of the lever with the drum to the contact point with the housing and with said guiding means determining the amplification of the transmitted power holding the clutch in its engaged position when the hammer drill is in operaton.

17. A hammer drill as defined in claim 16, wherein said separating spring is arranged between and supported on said clutch parts.

18. A hammer drill as defined in claim 16, wherein said separating spring is arranged outside said coupling to act on said movable clutch part in disengaging direction via an intermediate member.

19. A hammer drill as defined in claim 18, wherein said power transmitting lever is provided with a hook-shaped catch engaging a flange in said drum, and said separating spring acting on said lever to move by means of said catch the drum in the disengaging direction.

20. A hammer drill as defined in claim 19, wherein said lever is pivotably supported on said housing at a pivot point which is spaced apart from said hook-shaped catch.

21. A hammer drill as defined in claim 20, wherein the free end of said lever engages the percussive mechanism and said separating spring being arranged between the housing and said free end of the lever to act in the striking direction of the percussive mechanism and upon relief of the retroacting pressure the separating spring pivots the lever into its initial position in which the hook-shaped catch displaces the drum and hence the movable clutch into a disengaged position and a part of the lever acts as a stop surface for limiting the axial displacement of the drum and for braking its rotation.

* * * * *